US008807698B2

(12) United States Patent
Seki et al.

(10) Patent No.: US 8,807,698 B2
(45) Date of Patent: Aug. 19, 2014

(54) INKJET PRINTING APPARATUS AND INKJET PRINTING METHOD

(75) Inventors: Satoshi Seki, Kawasaki (JP); Hiroshi Tajika, Yokohama (JP); Takeshi Yazawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 13 days.

(21) Appl. No.: 13/216,723

(22) Filed: Aug. 24, 2011

(65) Prior Publication Data

US 2012/0050369 A1 Mar. 1, 2012

(30) Foreign Application Priority Data

Aug. 31, 2010 (JP) ..... 2010-195064

(51) Int. Cl.
*B41J 2/015* (2006.01)

(52) U.S. Cl.
USPC ..... 347/21; 347/14; 347/98

(58) Field of Classification Search
None
See application file for complete search history.

(56) References Cited

U.S. PATENT DOCUMENTS

| | | | | |
|---|---|---|---|---|
| 6,102,537 | A | 8/2000 | Kato et al. | |
| 6,193,361 | B1 | 2/2001 | Wen | |
| 6,267,476 | B1 | 7/2001 | Kato et al. | |
| 7,121,660 | B2 | 10/2006 | Ide et al. | |
| 8,097,075 | B2 | 1/2012 | Oyanagi et al. | |
| 8,105,429 | B2 | 1/2012 | Oyanagi et al. | |
| 2005/0024399 | A1* | 2/2005 | Fukuda et al. | 347/9 |
| 2005/0190248 | A1* | 9/2005 | Konno et al. | 347/102 |
| 2010/0009136 | A1 | 1/2010 | Oyanagi et al. | |
| 2011/0037804 | A1 | 2/2011 | Oyanagi et al. | |

FOREIGN PATENT DOCUMENTS

| | | | |
|---|---|---|---|
| CN | 101518994 | A | 9/2009 |
| CN | 101701115 | A | 5/2010 |
| JP | 2004-090323 | A | 3/2004 |
| JP | 2004-122496 | A | 4/2004 |
| JP | 2006-088529 | A | 4/2006 |
| JP | 2008059504 | A | 3/2008 |

OTHER PUBLICATIONS

Chinese Office Action issued in counterpart application No. 201110254142.7 dated Oct. 30, 2013, along with its English-language translation—14 pages.

* cited by examiner

*Primary Examiner* — Justin Seo
(74) *Attorney, Agent, or Firm* — Fitzpatrick, Cella, Harper & Scinto

(57) ABSTRACT

The first print data indicating the discharging amounts of color and clear inks is generated in correspondence with an image to be printed with the color and clear inks. The second print data for designating a region for expressing decoration is generated. The discharging amount of the clear ink in the region for expressing decoration in the first print data is changed based on the second print data. Printing is done by scanning a printhead a plurality of number of times based on the changed first print data to execute the print scan of the clear ink after that of the color ink.

24 Claims, 17 Drawing Sheets

INKJET PRINTING APPARATUS AND INKJET PRINTING METHOD

BACKGROUND OF THE INVENTION

1. Field of the Invention

The present invention relates to an inkjet printing apparatus and inkjet printing method for printing using a color material-containing ink and color material-free clear ink.

2. Description of the Related Art

Recently, inkjet printing apparatuses have high expectations placed on them to form high-quality images on various printing media. The inkjet printing apparatuses are required to even produce images with photographic image quality, and widely use glossy paper capable to create the same image quality and texture as those of a silver halide photograph.

There are various requirements for images to be printed on glossy paper. For example, a photograph is sometimes decorated with a text and graphic for a poster or the like. Conventionally in decoration, the text and graphic come to the foreground, and a photograph portion under the text and graphic is filled and cannot be seen. Even if the advertisement tries to emphasize both the item and advertising copy, the inserted text and graphic hide part of the item. To insert a photograph so as not to overlap the text and graphic, the photograph needs to be downsized, and the item cannot appeal to customers.

Under the circumstances, there is a demand for printing an image with a special effect that utilizes a difference in glossiness by forming both a highly glossy region and less glossy region on a single printing medium. For example, a text image is printed at low glossiness in a partial region while a photographic image is printed at high glossiness on the entire surface. Such a printed material has an effect in which the text is seen as if it popped up when the user sees the printed material from a different angle. This effect is often used in a discharging purpose "decoration printing" for catalogs and graphic arts.

U.S. Pat. No. 6,193,361 and Japanese Patent Laid-Open No. 2004-122496 describe the use of a colorless clear ink to control gloss in order to achieve the above discharging purpose. In U.S. Pat. No. 6,193,361 and Japanese Patent Laid-Open No. 2004-122496, the scan count in printing the clear ink or thinned data of each scan is changed to roughen the surface and control the glossiness, thereby expressing a plurality of glosses on a printed material.

Both methods disclosed in U.S. Pat. No. 6,193,361 and Japanese Patent Laid-Open No. 2004-122496 change the glossiness by roughening the image surface. These methods decrease the glossiness defined by reflection of light, but worsen haze (image clarity). At a decorated portion, the photograph surface becomes hazy.

SUMMARY OF THE INVENTION

An aspect of the present invention is to eliminate the above-mentioned problems with the conventional technology. The present invention provides an inkjet printing apparatus and inkjet printing method capable of printing a glossy image while suppressing a decrease in haze in decoration printing using a clear ink.

The present invention in its first aspect provides an inkjet printing apparatus which prints an image using a printhead for discharging at least one type of color ink containing a color material and a clear ink containing no color material, comprising: a first generation unit configured to generate first print data indicating discharging amounts of the color ink and the clear ink in correspondence with an image to be printed with the color ink and the clear ink; a second generation unit configured to generate second print data for designating a region for expressing decoration; a change unit configured to change, based on the second print data, the discharging amount of the clear ink in the region for expressing decoration in the first print data; and a print control unit configured to control to print by scanning the printhead a plurality of number of times based on the changed first print data to execute a print scan of the clear ink after a print scan of the color ink.

The present invention in its second aspect provides an inkjet printing method of printing an image using a printhead for discharging at least one type of color ink containing a color material and a clear ink containing no color material, comprising: a first generation step of generating first print data indicating discharging amounts of the color ink and the clear ink in correspondence with an image to be printed with the color ink and the clear ink; a second generation step of generating second print data for designating a region for expressing decoration; a change step of changing, based on the second print data, the discharging amount of the clear ink in the region for expressing decoration in the first print data; and a printing step of controlling to print by scanning the printhead a plurality of number of times based on the changed first print data to execute a print scan of the clear ink after a print scan of the color ink.

The present invention can print a glossy image while suppressing a decrease in haze in decoration printing using a clear ink.

Further features of the present invention will become apparent from the following description of exemplary embodiments with reference to the attached drawings.

DESCRIPTION OF THE EMBODIMENTS

Figure 1:
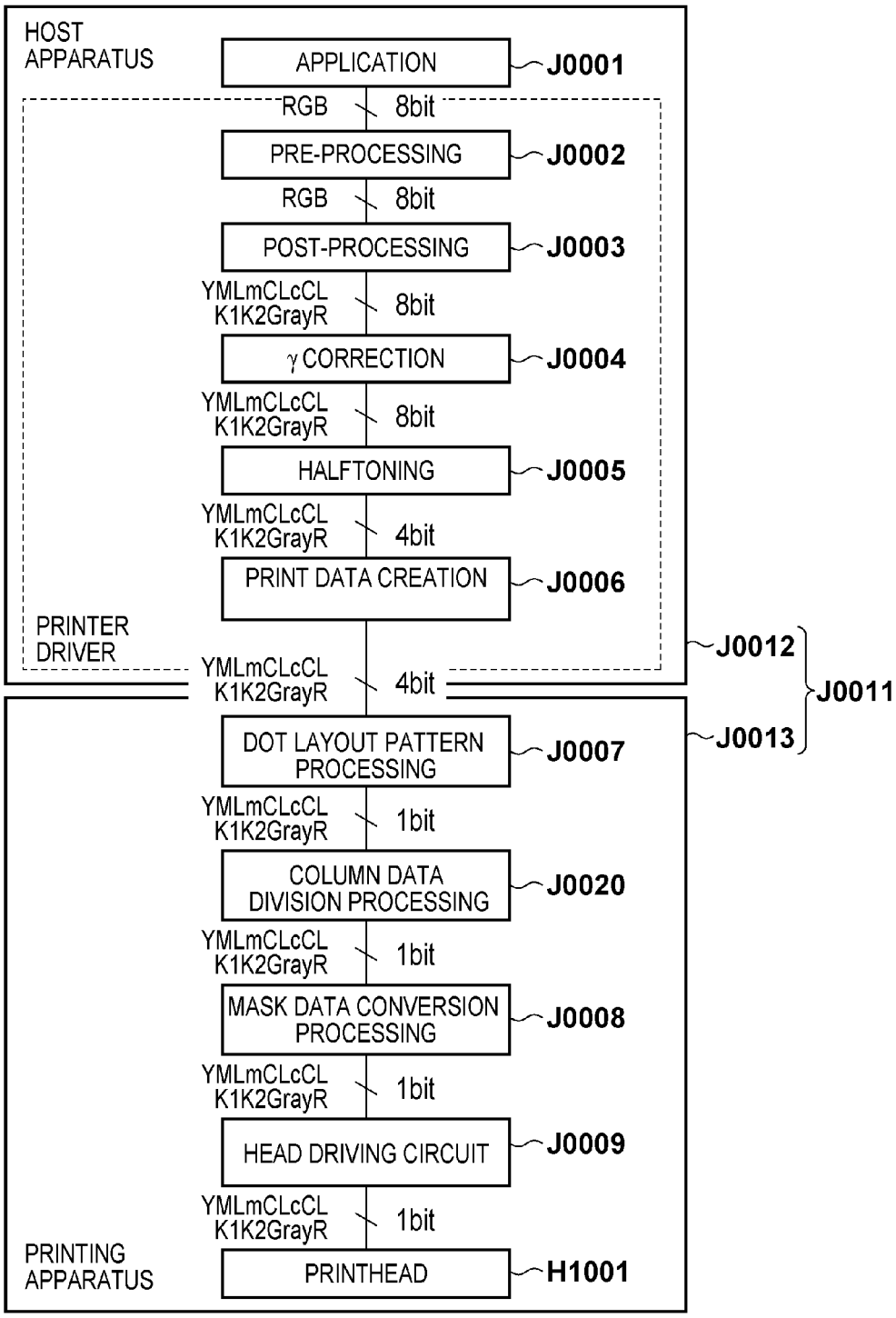
FIG. 1 is a block diagram for explaining the sequence of image data processing.

Preferred embodiments of the present invention will now be described hereinafter in detail, with reference to the accompanying drawings. It is to be understood that the following embodiments are not intended to limit the claims of the present invention, and that not all of the combinations of the aspects that are described according to the following embodiments are necessarily required with respect to the means to solve the problems according to the present invention. Note that the same reference numerals denote the same parts, and a repetitive description thereof will be omitted.

[1. Basic Arrangement]

[1.1 Outline of Printing System]

FIG. 1 is a block diagram for explaining the sequence of image data processing in a printing system in an embodiment. A printing system J0011 includes a host apparatus J0012 such as a PC and a printing apparatus J0013. The host apparatus J0012 generates image data representing an image to be printed, and sets a UI (User Interface) for data generation. The printing apparatus J0013 prints on a printing medium based on image data generated by the host apparatus J0012.

The printing apparatus prints with 10 color inks including one or more types of color inks out of cyan (C), light cyan (Lc), magenta (M), light magenta (Lm), yellow (Y), red (R), first black (K1), second black (K2), gray (Gray), and clear (CL). For this purpose, the printing apparatus uses a printhead H1001 which discharges a total of 10 color inks. These 10 color inks are pigment inks each containing a pigment as a color material.

Programs running on the operating system of the host apparatus J0012 include an application and printer driver. An application J0001 executes image data creation processing (example of the first generation) for printing in the printing apparatus. The host apparatus J0012 receives, via various media, the image data or data before editing or the like. The host apparatus J0012 receives, via a CF card, for example, JPEG image data captured by a digital camera. The host apparatus J0012 receives TIFF image data read by a scanner and image data stored in a CD-ROM. Further, the host apparatus J0012 receives data on a website via the Internet. These received data are displayed on the monitor of the host apparatus J0012, and edited and processed via the application J0001 to create, for example, sRGB image data R, G, and B. On a UI screen displayed on the monitor of the host apparatus J0012, the user sets the type of printing medium used for printing, the print quality, and the like, and issues a print instruction. In accordance with the print instruction, the image data R, G, and B are transferred to the printer driver.

Processing in the printer driver includes pre-processing J0002, post-processing J0003, γ correction processing J0004, halftone processing J0005, and print data creation processing J0006. The processes J0002 to J0006 to be executed by the printer driver will be explained briefly.

(A) Pre-processing J0002

The pre-processing J0002 performs gamut mapping. In the embodiment, data conversion is executed to map a gamut reproduced by sRGB image data R, G, and B in a gamut reproduced by the printing apparatus J0013. More specifically, image data R, G, and B each of 256 tone levels expressed by 8 bits are converted into data R, G, and B each of 8 bits in the gamut of the printing apparatus J0013 by using a 3D LUT.

(B) Post-processing J0003

Based on the data R, G, and B each of 8 bits having undergone gamut mapping, the post-processing J0003 obtains color separation data Y, M, Lm, C, Lc, K1, K2, R, Gray, and CL of 10 colors each of 8 bits in correspondence with a combination of inks for reproducing a color represented by these data. CL is a clear ink. In the embodiment, color separation data are obtained using interpolation calculation in addition to the 3D LUT, similar to the pre-processing J0002.

(C) γ Correction Processing J0004

The γ correction processing J0004 converts each color data of the color separation data obtained by the post-processing J0003 into a density value (tone value). More specifically, the color separation data is converted to linearly correspond to the tone characteristic of the printer by using a 1D LUT corresponding to the tone characteristic of each color ink in the printing apparatus J0013.

(D) Halftone Processing J0005

The halftone processing J0005 performs quantization to convert each of the color separation data Y, M, Lm, C, Lc, K1, K2, R, Gray, and CL (clear ink) each of 8 bits having undergone the γ correction processing J0004 into 4-bit data. In the embodiment, 8-bit data of 256 tone levels is converted into 4-bit data of nine tone levels by using an error diffusion method. The 4-bit data serves as an index indicating a layout pattern in dot layout pattern processing in the printing apparatus.

(E) Print Data Creation Processing J0006

As final processing performed by the printer driver, the print data creation processing J0006 creates print data by adding print control information to print image data whose content is the 4-bit index data.

Figure 2:
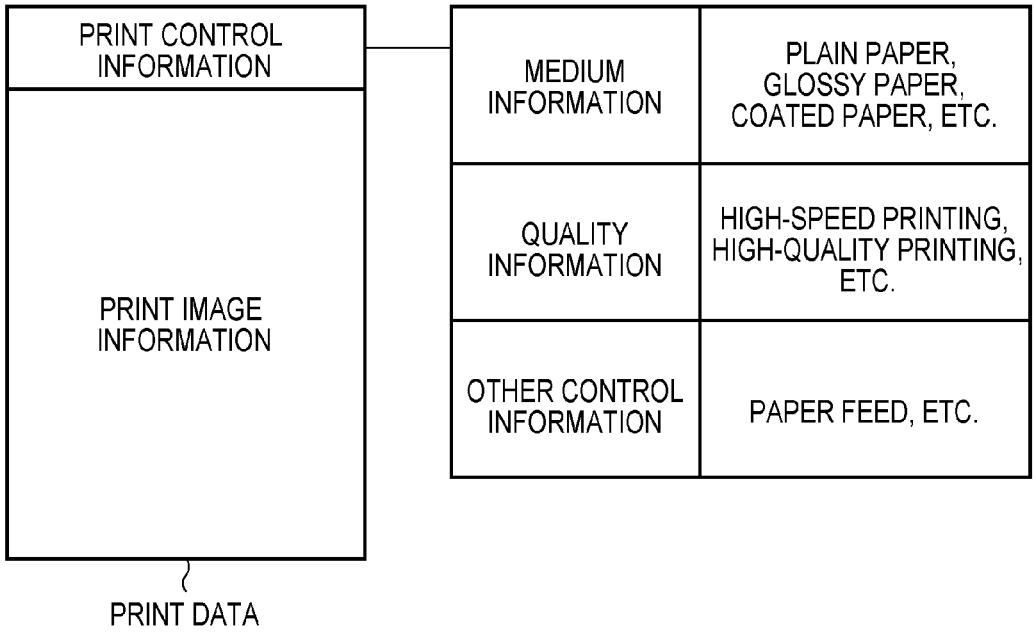
FIG. 2 is a view exemplifying the structure of print data.

FIG. 2 is a view exemplifying the structure of print data. The print data is formed from print control information for controlling printing, and print image information (the above-mentioned 4-bit index data) indicating an image to be printed. The print control information includes "printing medium information", "print quality information", and "other control information" such as the paper feed method. The printing medium information describes the type of printing medium to be printed, and defines any one type of printing medium out of plain paper, glossy paper, postcard, printable disk, and the like. The print quality information describes the print quality, and defines any one type of quality out of "fine", "standard", "quick", and the like. These pieces of print control information are generated based on contents designated by the user on a UI screen displayed on the monitor of the host apparatus J0012. The print image information describes image data generated by the halftone processing J0005. Print data generated in this way is supplied from the host apparatus J0012 to the printing apparatus J0013.

The printing apparatus J0013 performs dot layout pattern processing J0007 and mask data conversion processing J0008 (to be described below) for the print data supplied from the host apparatus J0012.

(F) Dot Layout Pattern Processing J0007

The halftone processing J0005 decreases multi-valued density information (8-bit data) of 256 tone levels to tone value information (4-bit data) of 9 tone levels. However, data which can be actually printed by the printing apparatus J0013 is binary data (1-bit data) indicating whether to print an ink dot. The dot layout pattern processing J0007 assigns a dot layout pattern corresponding to the tone value (one of levels 0 to 8) of each pixel to the pixel expressed by 4-bit data of one of tone levels 0 to 8 that is an output value from the halftone processing J0005. In this manner, whether to print an ink dot (ON/OFF of a dot) is defined in each of a plurality of areas within one pixel, and 1-bit binary data "1" or "0" is arranged in each area within one pixel. "1" is binary data indicating to print a dot, and "0" is binary data indicating not to print a dot.

Figure 3:
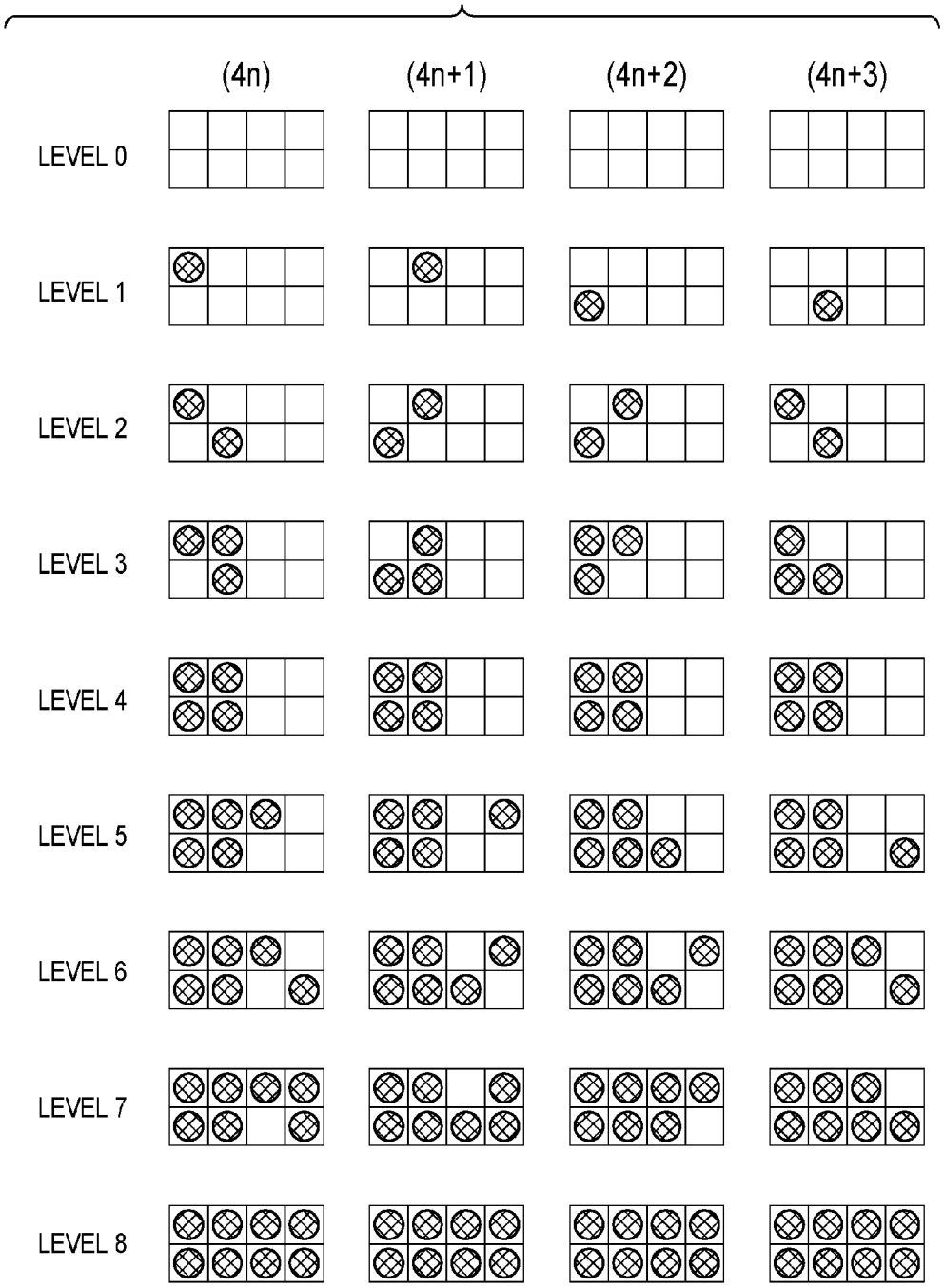
FIG. 3 is a view showing output patterns corresponding to input levels 0 to 8 that are converted in dot layout pattern processing.

FIG. 3 shows output patterns corresponding to input levels 0 to 8 that are converted in the dot layout pattern processing J0007 in this example. Level values shown on the left side in FIG. 3 correspond to levels 0 to 8 which are output values from the halftone processing J0005 in the host apparatus J0012. A region of 2×4 areas in the right side corresponds to the region of one pixel output from the halftone processing J0005. Each area within one pixel corresponds to a minimum unit for which ON/OFF of a dot is defined. In this specification, the "pixel" is a minimum unit capable of a tone representation, and is a minimum unit to undergo image processes (for example, the pre-processing J0002 to halftone processing J0005) for multi-valued data of a plurality of bits.

Referring to FIG. 3, an area indicated by ○ is an area to print a dot. As the level number rises, the number of dots to be printed increases one by one. In the embodiment, density information of an original image is reflected finally in this form. In FIG. 3, "(4n)" to "(4n+3)" indicate pixel positions in the lateral direction from the left end of image data to be printed, by substituting an integer of 1 or more into n. Respective patterns below "(4n)" to "(4n+3)" mean that different patterns are prepared for respective pixel positions even at the same input level. That is, even when the same level is input, four types of dot layout patterns indicated by "(4n)" to "(4n+3)" are cyclically assigned on a printing medium.

In FIG. 3, the longitudinal direction is a direction in which the orifices of the printhead are arrayed, and the lateral direction is a printhead scanning direction. The arrangement which prints using different dot layouts even for the same level has an effect of distributing the ink discharge count between nozzles on the upper stage of the dot layout pattern and those on the lower stage. Further, this arrangement has an effect of distributing various noise components specific to the printing apparatus J0013. At the end of the dot layout pattern processing J0007, all dot layout patterns for a printing medium are determined.

(G) Mask Data Conversion Processing J0008

The dot layout pattern processing J0007 determines the presence/absence of a dot in each area on a printing medium. Binary data indicating the dot layout is input to the driving circuit J0009 of the printhead H1001, printing a desired image. In this case, so-called 1-pass printing can be executed by completing printing in a single scan region on a printing medium by one scan. However, so-called multi-pass printing in which printing in a single scan region on a printing medium is completed by a plurality of scans will be exemplified below.

Figure 4:
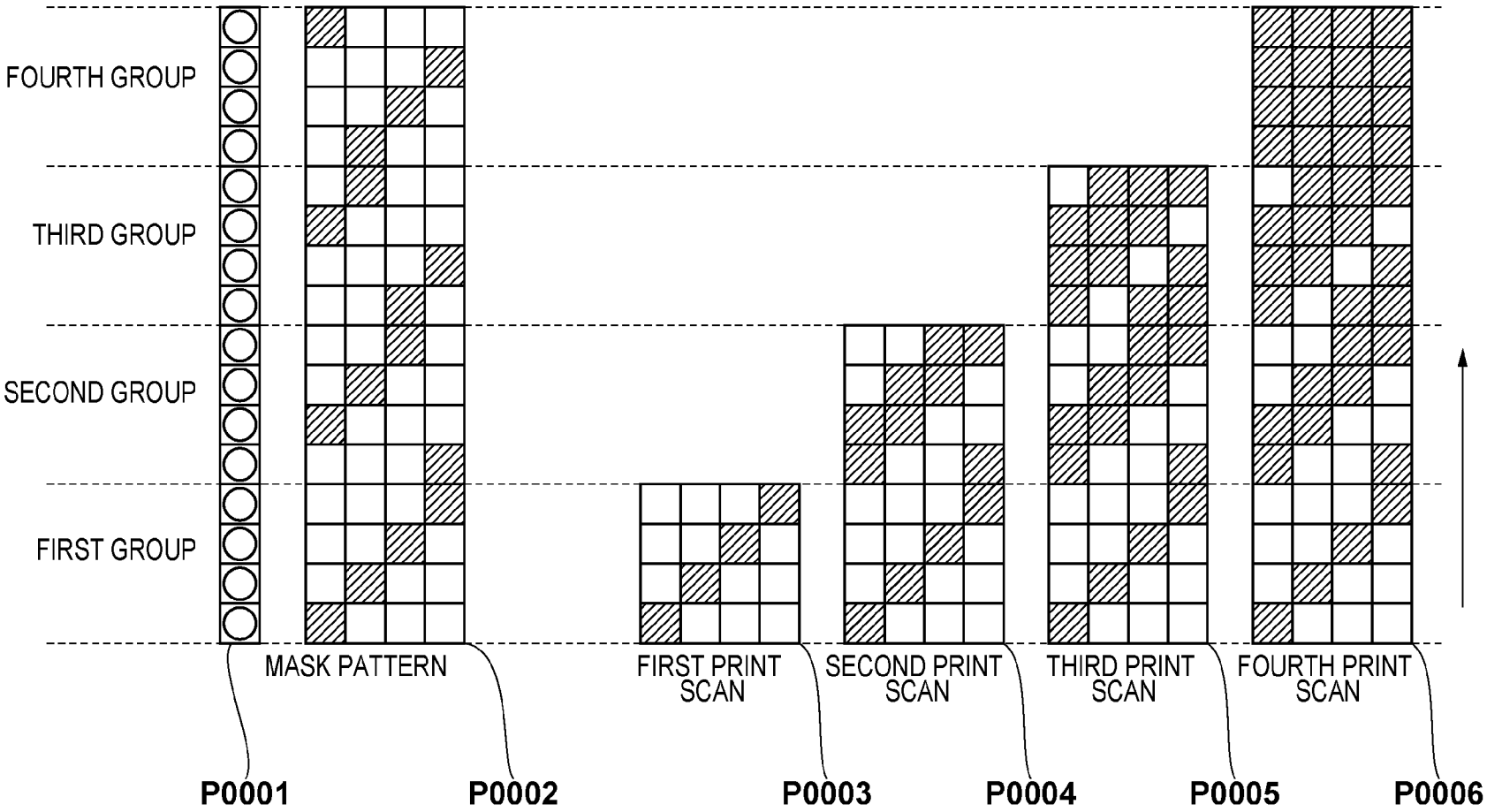
FIG. 4 is a view schematically showing a printhead and printing pattern.

FIG. 4 schematically shows a printhead and printing pattern to explain the multi-pass printing method. The printhead H1001 in the embodiment has a nozzle array including 768 nozzles in practice. However, for simplicity, assume that the printhead H1001 has 16 nozzles. The nozzles are divided into four, first to fourth nozzle groups, as shown in FIG. 4, and each nozzle group includes four nozzles. A mask pattern P0002 is formed from first to fourth mask patterns P0002*a* to P0002*d*. The first to fourth mask patterns P0002*a* to P0002*d* define areas printable by the first to fourth nozzle groups. A solid area in the mask pattern is a printing-permitted area, and a blank area is a printing-inhibited area. The first to fourth mask patterns P0002*a* to P0002*d* are complementary to each other. These four mask patterns are superposed, completing printing in a region corresponding to 4×4 areas.

Patterns P0003 to P0006 show states in which an image is completed by repeating the print scan. Every time the print scan ends, the printing medium is conveyed by the width (four nozzles in FIG. 4) of the nozzle group in a direction indicated by the arrow in FIG. 4. An image is completed by four print scans in a single region (region corresponding to the width of each nozzle group) on a printing medium. Nozzle-specific variations, variations of the printing medium conveyance precision, and the like can be reduced by forming a single region on a printing medium by a plurality of scans using a plurality of nozzle groups in this fashion.

Figure 5:
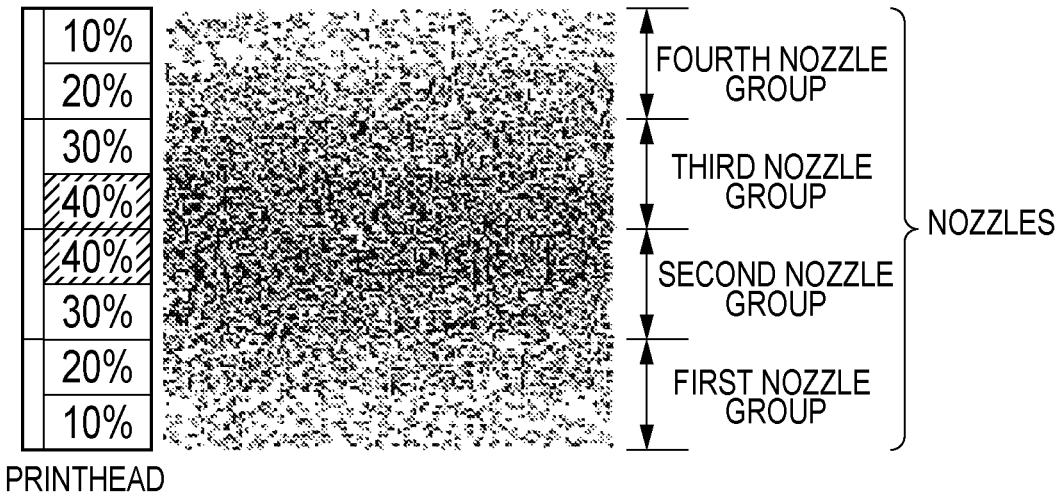
FIG. 5 is a view exemplifying an applicable mask pattern.

FIG. 5 exemplifies a mask pattern actually applicable in the embodiment. The printhead H1001 applied in this example has 768 nozzles, and 192 nozzles belong to each of the four nozzle groups. The mask pattern dimensions are defined by 768 areas equal to the number of nozzles in the longitudinal direction and 256 areas in the lateral direction. Four mask patterns respectively corresponding to the four nozzle groups are complementary to each other.

It is known that an air flow is generated near the printing unit in a print operation and affects the discharge direction of ink especially from nozzles positioned at the end of the printhead when discharging many small droplets from the inkjet printhead at high frequency. As is apparent from FIG. 5, the mask pattern in the embodiment localizes the distribution of the printing permission ratio between the respective nozzle groups or between regions even in a single nozzle group. An adverse effect by a shift of the landing positions of ink droplets discharged from nozzles at the end can be made less conspicuous by applying a mask pattern in which the printing permission ratio of nozzles at the end is set lower than that at the center, as shown in FIG. 5.

The printing permission ratio defined by the mask pattern is given by printing-permitted areas (solid areas in the mask pattern P0002 of FIG. 4) and printing-inhibited areas (blank areas in the mask pattern P0002 of FIG. 4). That is, the printing permission ratio is the percentage expression of the ratio of the number of printing-permitted areas to the sum of the numbers of printing-permitted areas and printing-inhibited areas which form the mask pattern. Letting M be the number of printing-permitted areas of the mask pattern and N be that of printing-inhibited areas, the printing permission ratio (%) of the mask pattern is $M \div (M+N) \times 100$.

In the embodiment, the memory in the printing apparatus main body stores mask data as shown in FIG. 5. The mask data conversion processing J0008 ANDs the mask data and binary data obtained by the dot layout pattern processing J0007, determining binary data to be printed by each print scan. This binary data is transferred to the head driving processing J0009. Then, the printhead H1001 is driven to discharge ink in accordance with the binary data.

In FIG. 1, the host apparatus J0012 executes the pre-processing J0002, post-processing J0003, γ correction processing J0004, halftone processing J0005, and print data creation processing J0006. The printing apparatus J0013 executes the dot layout pattern processing J0007 and mask data conversion processing J0008. However, the printing apparatus J0013 may execute some of the processes J0002 to J0005 which are executed in the host apparatus J0012, or the host apparatus J0012 may execute all of them. Alternatively, the printing apparatus J0013 may execute the processes J0002 to J0008.

[1.2 Apparatus Arrangement]

Figure 6:
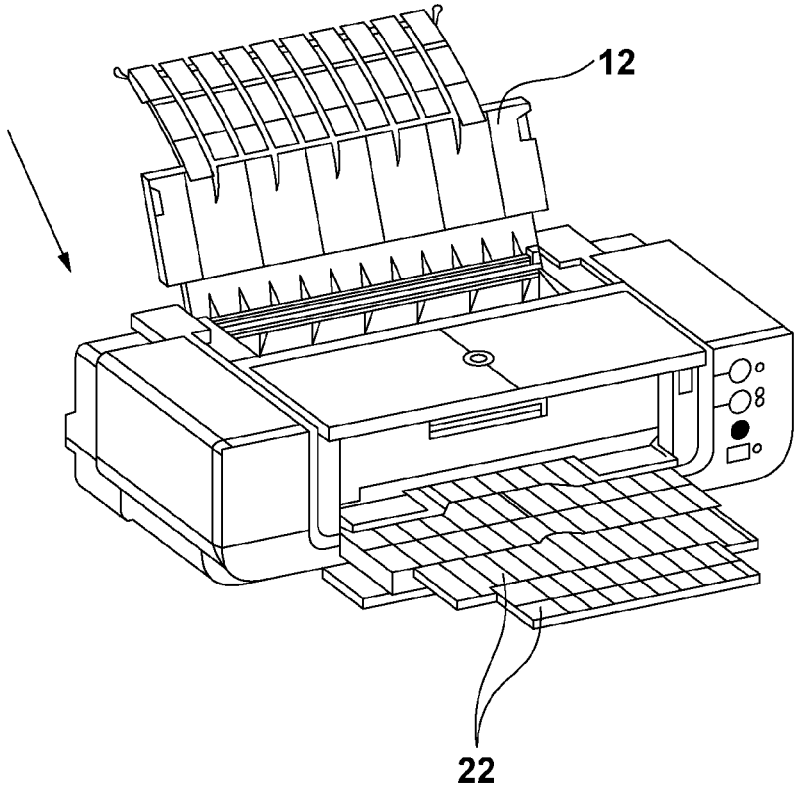
FIG. 6 is a perspective view showing the outer appearance of an inkjet printing apparatus.
Figure 7:
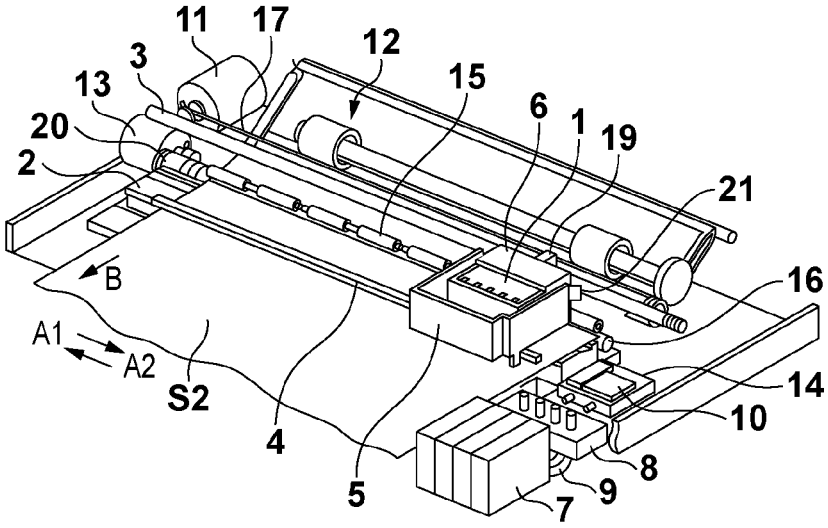
FIG. 7 is a perspective view showing the interior of the inkjet printing apparatus.

FIG. 6 is a perspective view showing the outer appearance of an inkjet printing apparatus in the embodiment. FIG. 7 is a perspective view showing the interior of the inkjet printing apparatus.

In the embodiment, a printing medium is inserted from a paper feed tray 12 in a direction indicated by the arrow in FIG. 6, intermittently conveyed to form an image, and then discharged onto a discharge tray 22.

Referring to FIG. 7, a printhead 1 mounted on a carriage 5 discharges ink from nozzles while reciprocating along a guide rail 4 in directions indicated by arrows A1 and A2, thereby forming an image on a printing medium S2. The printhead 1 has, for example, a plurality of nozzle arrays corresponding to inks of different colors and an image quality improvement liquid. An example is a group of nozzle arrays for discharging inks of cyan (C), magenta (M), yellow (Y), black 1 (K1), black 2 (K2), light cyan (LC), light magenta (LM), red (R), gray (Gray), and clear (CL). These color inks and image quality improvement liquid are stored in ink tanks (not shown) and supplied from the ink tanks to the printhead 1.

In the embodiment, the ink tanks and printhead 1 are integrated to form a head cartridge 6, and the head cartridge 6 is mounted on the carriage 5. A timing belt 17 transfers the driving force of a carriage motor 11 to the carriage 5 to reciprocate the carriage 5 along a guide shaft 3 and the guide rail 4 in the directions (main scanning direction) indicated by the arrows A1 and A2. When the carriage moves, an encoder sensor 21 attached to the carriage 5 reads a linear scale 19 arranged in the carriage moving direction, detecting the carriage position. By the reciprocal movement, printing on a printing medium starts. At this time, the printing medium S2 is supplied from the paper feed tray 12, clamped between a conveyance roller 16 and a pinch roller 15, and conveyed to a platen 2.

After the carriage 5 prints by one scan in the direction A1, a conveyance motor 13 drives the conveyance roller 16 via a linear wheel 20. Then, the printing medium S2 is conveyed by a predetermined amount in a direction indicated by an arrow B serving as the sub-scanning direction. While the carriage 5 scans in the direction A2, printing is done on the printing medium S2. At the home position, a head cap 10 and recovery unit 14 are arranged to perform recovery processing intermittently for the printhead 1, as needed. By repeating this operation, the printing of one printing medium ends. After that, the printing medium is discharged, which completes the printing of one printing medium.

Figure 8:
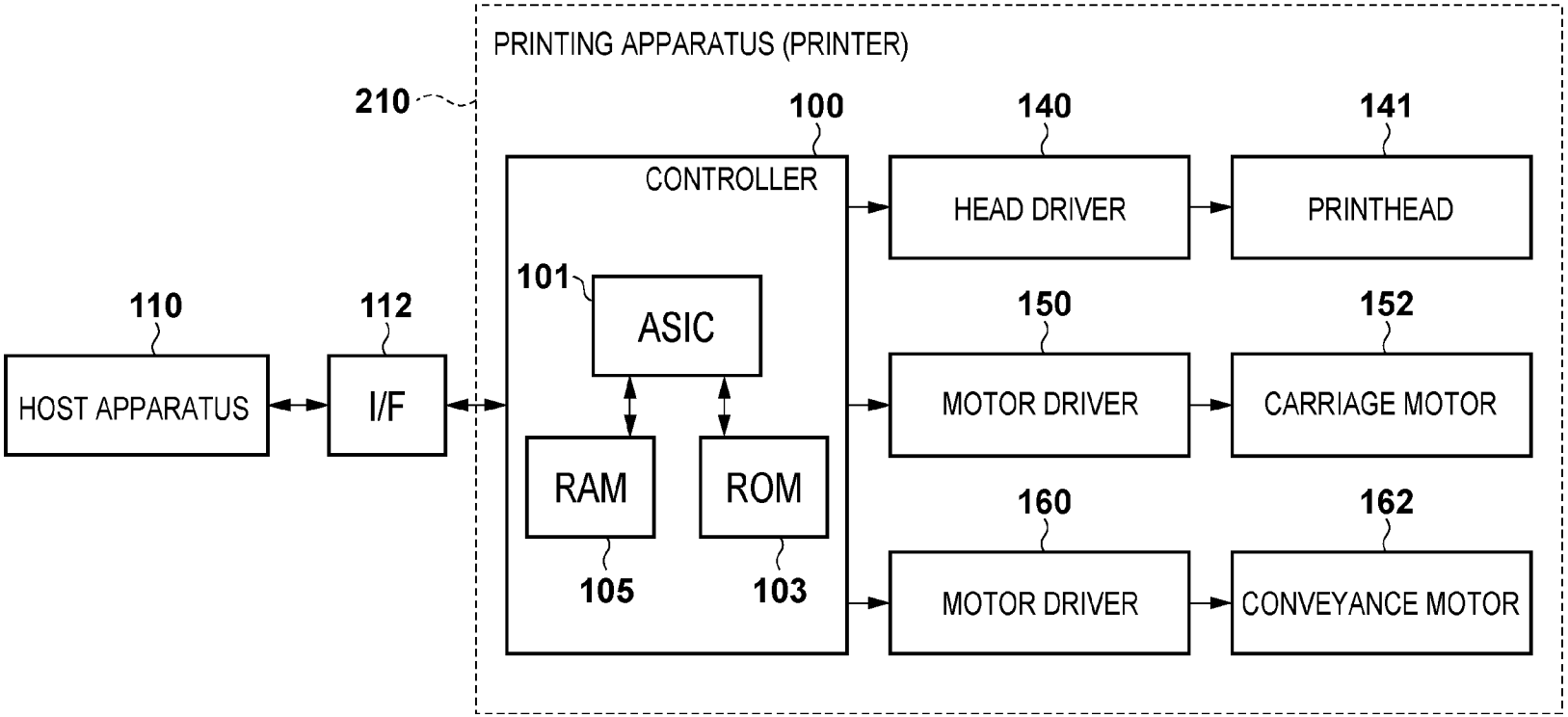
FIG. 8 is a block diagram showing the control arrangement of the inkjet printing apparatus.

FIG. 8 is a block diagram showing the control arrangement of the inkjet printing apparatus in the embodiment. A controller 100 is a main control unit and includes, for example, an ASIC 101, ROM 103, and RAM 105 to configure a microcomputer. The ROM 103 stores a dot layout pattern, mask pattern, and other permanent data. The RAM 105 has an area for rasterizing image data, a work area, and the like. The ASIC 101 executes a series of processes to read out a program from the ROM 103 and print image data on a printing medium. More specifically, a mask pattern is selected from information corresponding to the ink discharging amount to divide image data, generating print data for each pass. A host apparatus 110 is an image data supply source to be described later, and may take the form of an image reader or the like in addition to a computer which, for example, creates and processes image data to be printed. The host apparatus 110 transmits/receives image data, other commands, status signals, and the like to/from the controller 100 via an interface (I/F) 112. A head driver 140 drives a printhead 141 in accordance with print data or the like. A motor driver 150 drives a carriage motor 152, and a motor driver 160 drives a conveyance motor 162.

[1.3 Relationship between Glossiness and Image Clarity]

<Evaluation Method for Glossiness and Image Clarity>

Glossiness and image clarity on the printing medium surface will be explained as criteria for evaluating glossiness uniformity within an image in the embodiment. Glossiness and image clarity are indices for evaluating the gloss of a printing medium or image. An evaluation method for glossiness and image clarity, and the relationship between them will be explained below.

Figure 9A:
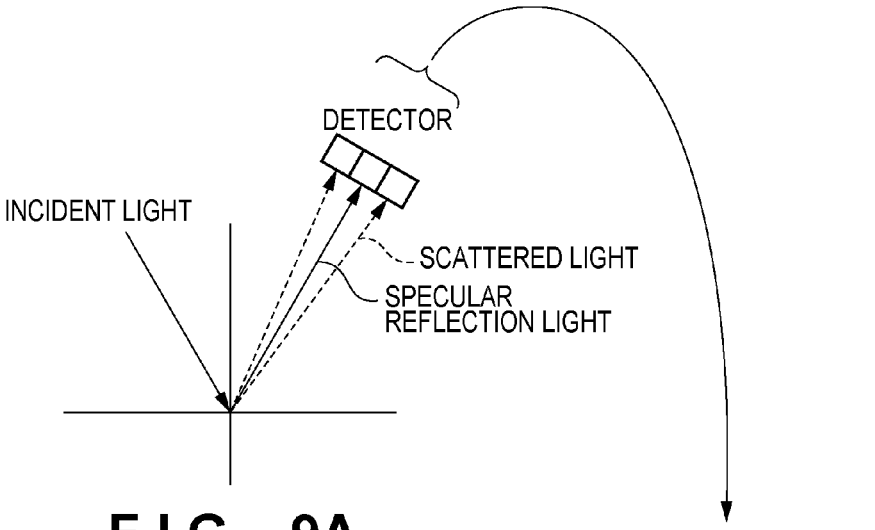
FIGS. 9A to 9D are views for explaining glossiness and haze.

In FIGS. 9A to 9D are views for explaining glossiness and haze. As shown in FIG. 9A, the values of a 20° specular glossiness (to be simply referred to as glossiness) and haze can be obtained by detecting light reflected by the surface of a printed material using a general detector. The reflected light is distributed at a given angle using the axis of specular reflection light as the center. As shown in 9D, the glossiness is detected at, for example, an opening width of 1.8° at the center of the detector, and haze is detected within the range of ±2.7° outside the opening. More specifically, when reflected light is observed, the reflectance of specular reflection light serving as the central axis of the distribution with respect to incident light is defined as glossiness. Scattered light generated near the specular reflection light in the reflected light distribution is measured and defined as haze or a haze value. The units of glossiness and haze measured by the detector are dimensionless. Glossiness complies with JIS K 5600, and haze complies with ISO DIS 13803. Image clarity is measured using, for example, JIS H 8686 "Test methods for image clarity of anodic oxide coatings on aluminum and aluminum alloy" or JIS K 7105 "Testing methods for optical properties of plastics". Image clarity indicates the sharpness of an image reflected in a printing medium. For example, when an illumination image reflected in a printing medium blurs, the image clarity value is small.

Figure 9B:
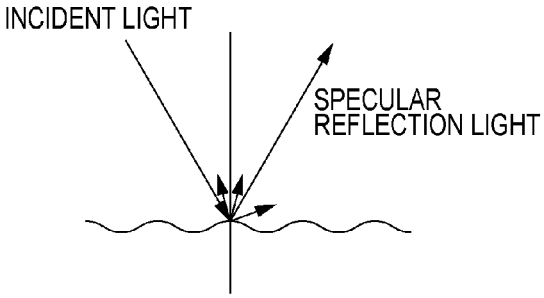
Figure 9D:
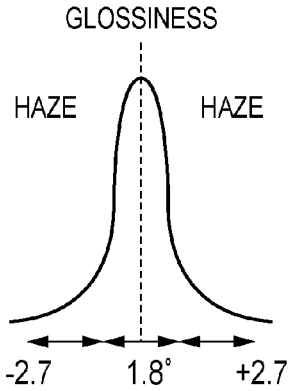
Figure 9C:
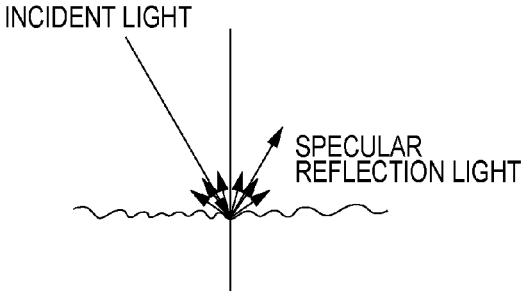

FIGS. 9B and 9C are views showing that the quantity and direction of reflected light change depending on the surface roughness of a printed image. As is shown in FIGS. 9B and 9C, a rougher surface generally diffuses reflected light much more to decrease the quantity of specular reflection light, and image clarity and glossiness are measured to be smaller. In the embodiment, a smaller measurement value of a measured image clarity than a target image clarity will be expressed as low image clarity. Also, a smaller measurement value of a measured glossiness than a target glossiness will be expressed as low glossiness.

<Relationship between Glossiness and Image Clarity>

Figures 10A, 10B, 10C:
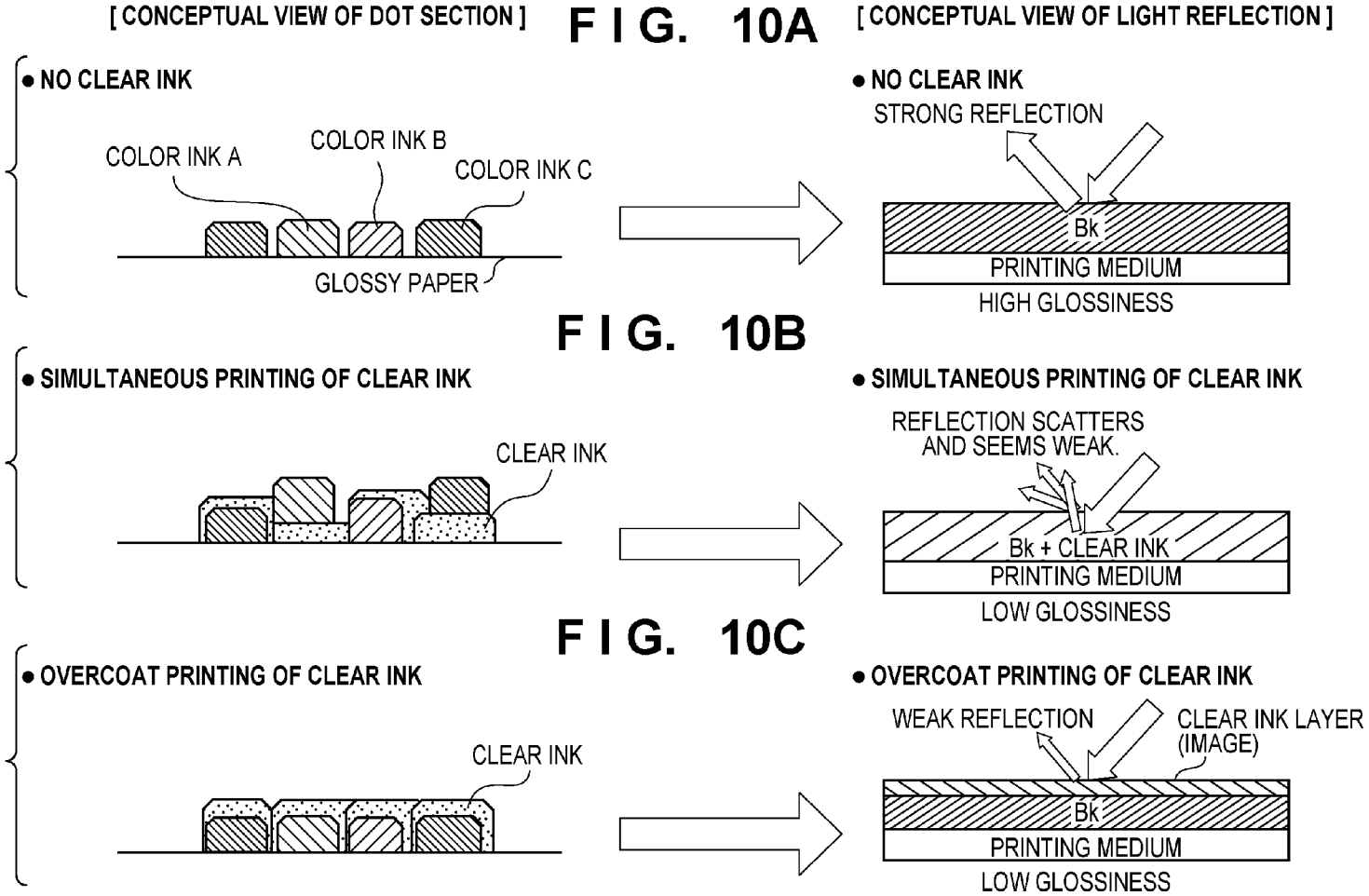
FIGS. 10A to 10C are views showing the difference in the state of a printed surface depending on the difference in superposition of color and clear inks.

When a clear ink is printed at the same time as a chromatic color ink or achromatic color ink, image clarity and glossiness further change depending on superposition of them. FIGS. 10A to 10C are views showing the difference in the state of a printed surface depending on the difference in superposition of the clear ink. FIG. 10A shows a case in which only chromatic color inks are printed without printing the clear ink. FIGS. 10B and 10C show cases in which the clear ink is printed by simultaneous printing and overcoat printing (to be described later), respectively.

In a relatively random printing method (to be referred to as simultaneous printing), the chromatic color ink and clear ink are printed simultaneously. Because of random print timings, the clear ink is printed on the chromatic color ink in some cases, and the chromatic color ink is printed on the clear ink in other cases, roughening the printed surface. As a result, light scatters, and image clarity and glossiness tend to decrease (FIG. 10B).

In a printing method of printing the chromatic and achromatic color inks and the clear ink at different timings, image clarity hardly drops and only glossiness tends to change greatly in accordance with the clear ink amount (FIG. 10C). Especially in a printing method of discharging the clear ink later (to be referred to as overcoat printing), the image glossiness decreases efficiently. More specifically, the clear ink printed in a low-glossiness region decreases the glossiness in accordance with the clear ink amount.

Figure 11A:
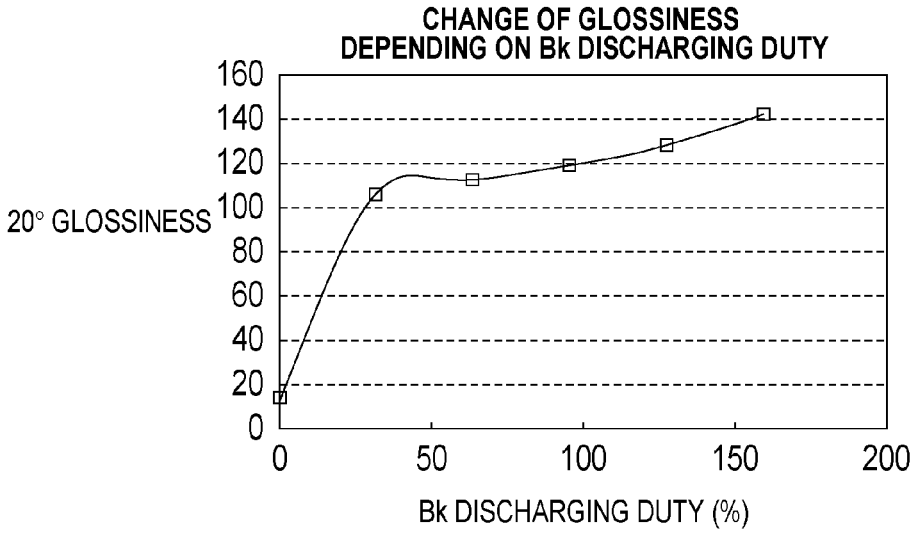
FIGS. 11A to 11D are graphs showing a change of the glossiness and haze.
Figure 11B:
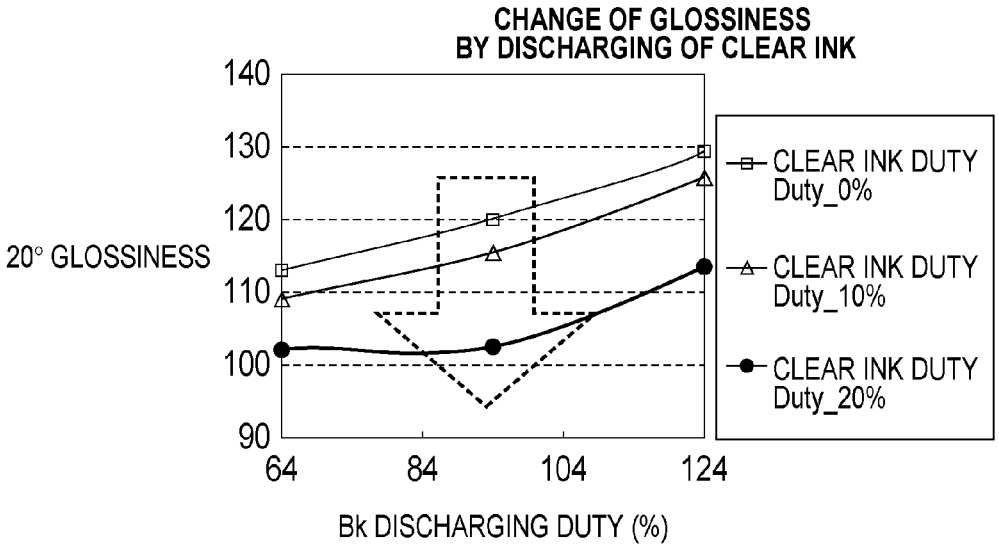

FIG. 11A shows the result of measuring the relationship of the glossiness to the Bk ink printing duty by using a general detector. In the example, a printing duty obtained when eight ink droplets of about 3.5 pl are printed in a pixel of 600 dpi×600 dpi is defined as 100%, details of which will be described later. As shown in FIG. 11A, the glossiness is high at a portion where the Bk ink printing duty is high. FIG. 11B shows a state in which overcoat printing of the clear ink in this region decreases the glossiness as the clear ink discharging amount increases (0%, 10%, and 20%). This is because overcoating with the clear ink lower in refractive index than the Bk ink forms a clear ink layer on the Bk ink layer, decreasing light reflection on the uppermost surface, as shown in FIG. 10C. In practice, the uppermost surface need not be completely covered with the clear ink, unlike FIGS. 10A to 10C.

Figure 11C:
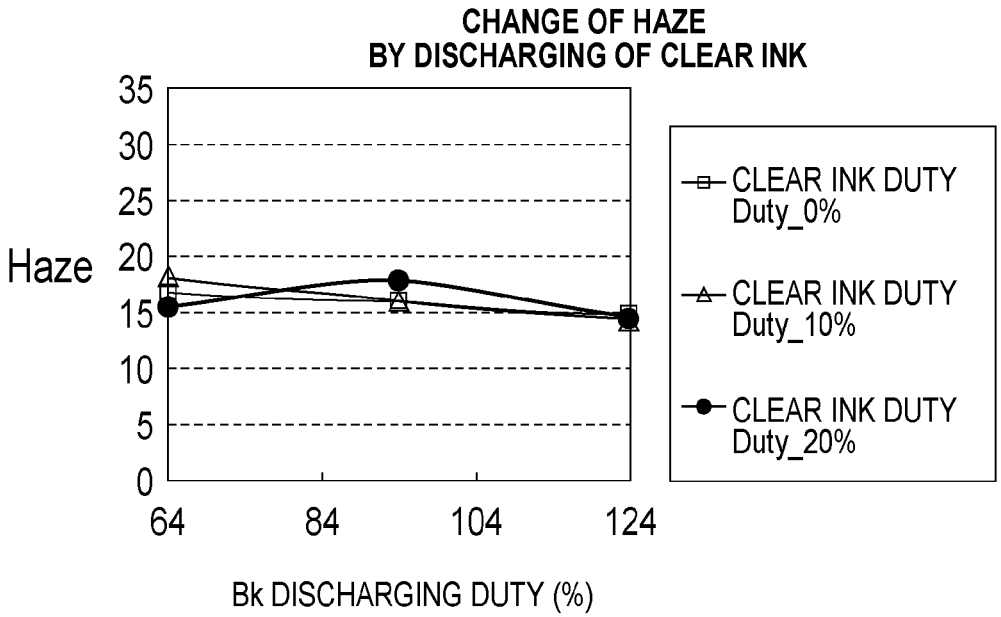
Figure 11D:
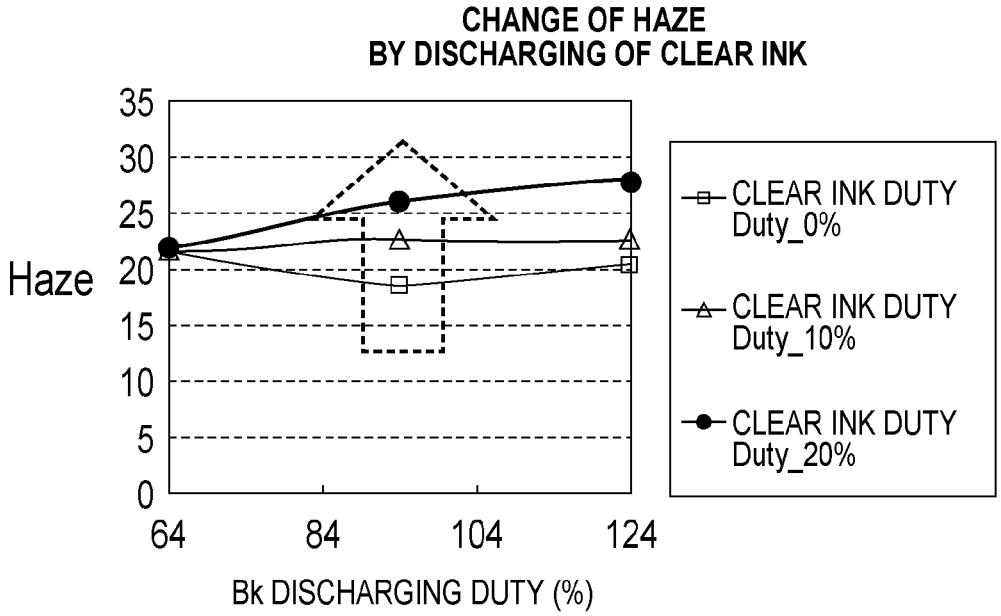

At this time, haze does not greatly change regardless of the clear ink discharging amount, as shown in FIG. 11C. However, in simultaneous printing, as the ink discharging amount increases, haze worsens and the surface becomes hazy, as shown in FIG. 11D. It is considered that simultaneous printing roughens the surface, as represented in FIG. 10C. To prevent this, the clear ink is discharged by overcoat printing to discharge it on the color ink.

[First Embodiment]

[Generation and Save of Decoration Print Data]

Figure 15:
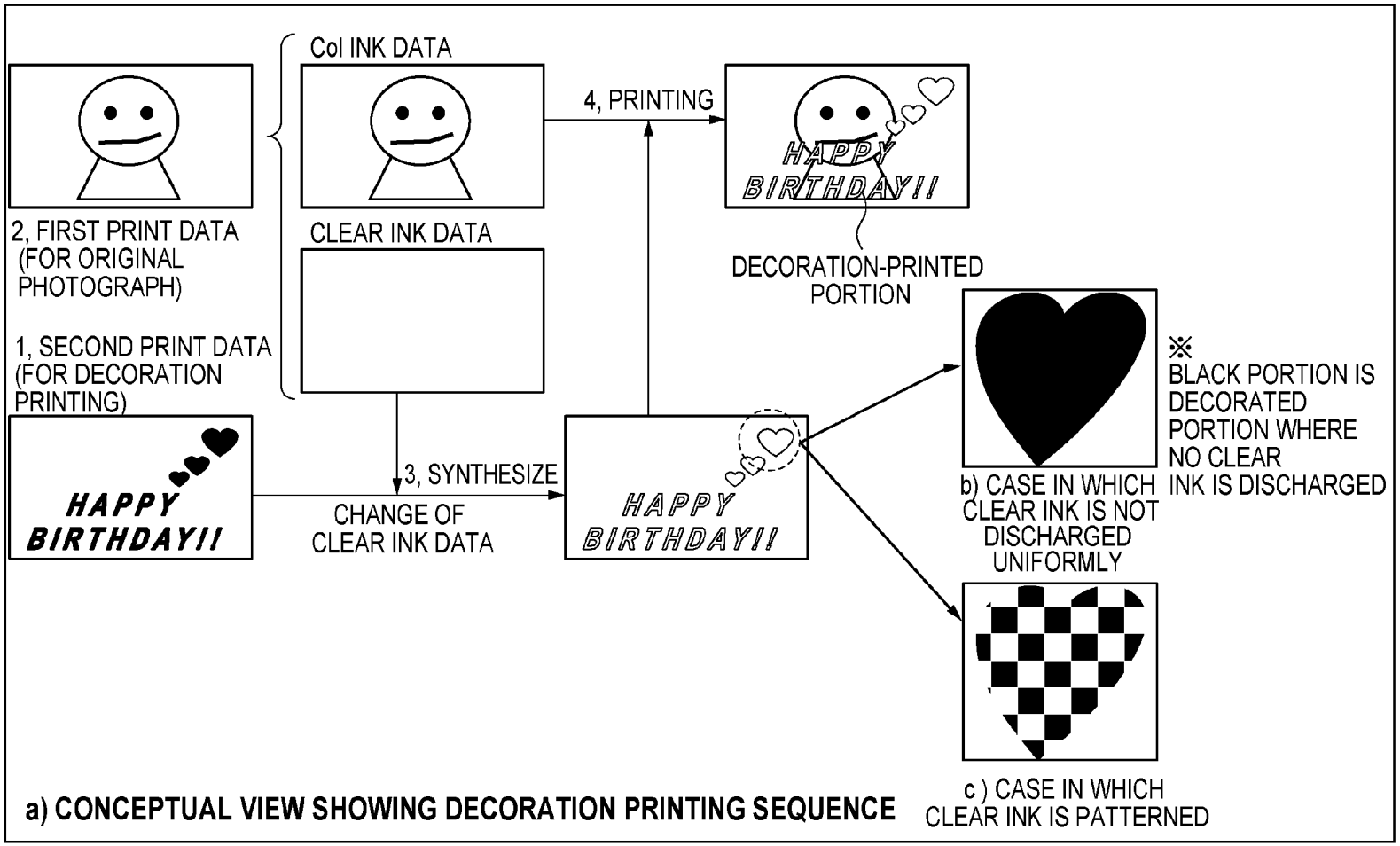
FIG. 15 is a view showing the concept of the overall decoration print processing.

The sequence of decoration print processing in an inkjet printing apparatus according to the first embodiment will be described. FIG. 15 is a view showing the concept of the overall decoration print processing.

Figure 14A:
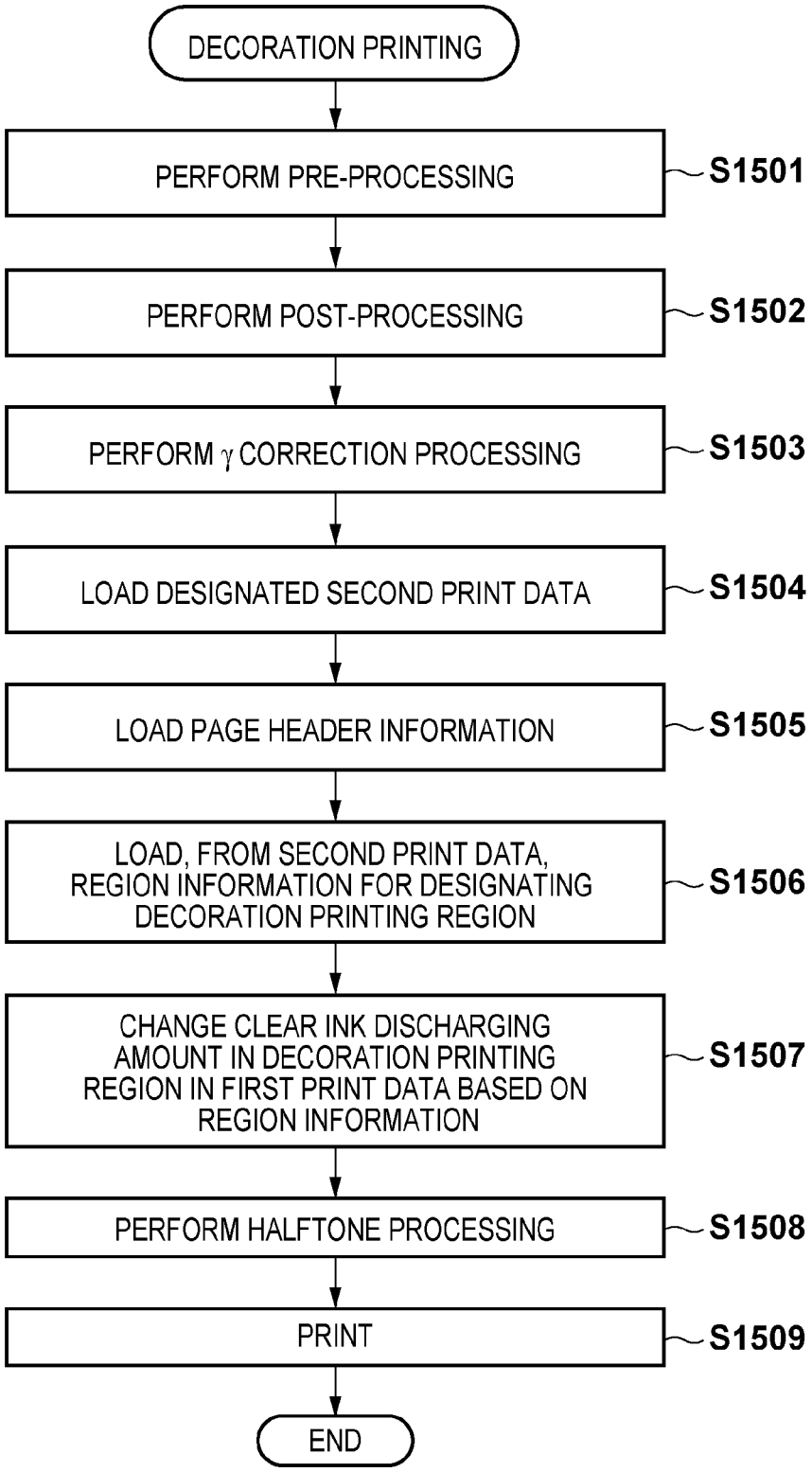
FIGS. 14A to 14C are flowcharts for explaining the sequence of decoration print processing.
Figure 14B:
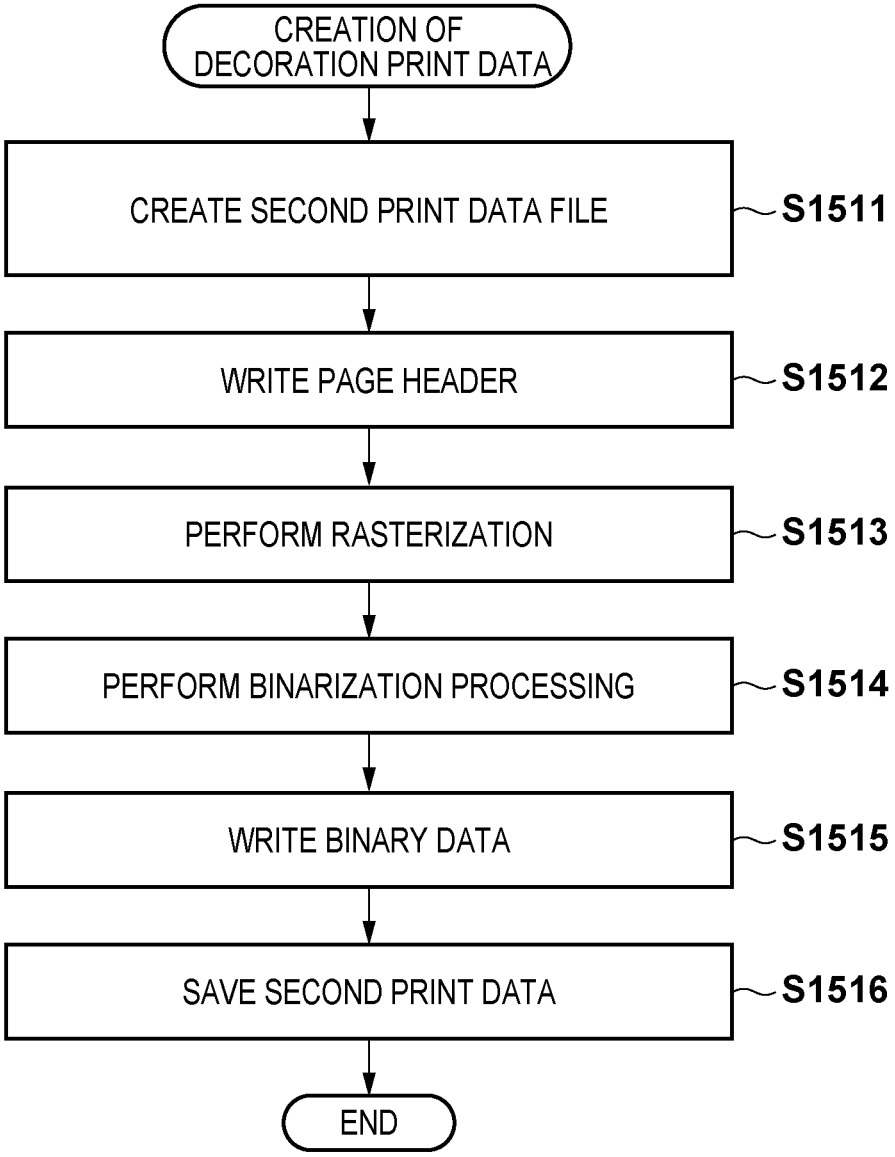

FIG. 14B is a flowchart showing the sequence of processing (example of the second generation) of generating decoration print data (to be also referred to as the second print data) for performing decoration printing. The user designates a portion to be decorated using an arbitrary discharging, and renders a text and graphic at the portion. The user selects decoration print data creation processing on a UI screen displayed on the monitor of a host apparatus J0012 shown in FIG. 1, and starts the second print data creation processing (step S1511).

In step S1512, a page header is written in the second print data. The page header contains the page ID, print settings, page size, width and height, page data position, and the like. The page ID is used to uniquely identify the page. The print settings are various print settings used when executing printing in a form file creation mode. The print settings include information about the paper size and print orientation. As the page size, a page size to be referred to by the page header is given by the number of bytes. As the width and height, those of the clear ink discharging amount change region (decoration portion) are given by the numbers of pixels. As the page data position, an offset position from the start of the second print data in the clear ink discharging amount change region is stored.

After the page header is written in the second print data in step S1512, the second print data is rasterized based the print job of the current page, creating multi-valued raster data in step S1513. In step S1514, the created multi-valued raster data is binarized. In the binarization, multi-valued raster data is binarized into "1" for a pure white region and "0" for other regions. The binary raster data represents clear ink discharging amount change region information in the current page. In the embodiment, a clear ink discharging amount in a region assigned with "0" upon binarization is changed in decoration printing to be described later. The binary raster data is written in the original second print data in step S1515, and the resultant second print data is saved in a predetermined storage area of an external storage device (not shown) such as a PC in step S1516.

[Sequence of Decoration Print Processing]

FIG. 14A is a flowchart showing the sequence of decoration print processing in the embodiment. The user selects decoration print processing on a UI screen displayed on the monitor of the host apparatus J0012 shown in FIG. 1, selects the second print data (decoration print data) created in advance, and starts decoration print processing for the first print data of an original image.

In steps S1501 to S1503, pre-processing J0002, post-processing J0003, and γ correction processing J0004 are performed for the first print data. These processes are the same as those described with reference to FIG. 1. The first print data is converted into 8-bit multi-valued data in step S1503. At this time, the clear ink CL has a predetermined value as 8-bit multi-valued data in the entire printing range of the first print data. The value of the clear ink CL may be a predetermined value which is constant in the entire printing range, or may be changed in accordance with the value (tone value) of multi-valued data of the color ink.

The second print data saved in advance is loaded in step S1504, and a page header written in the second print data is referred to in step S1505. In step S1506, region information is loaded from the page header into a RAM 105 to designate a region to undergo decoration printing. The region information for designating a region to undergo decoration printing is information of a region assigned with "0" (clear ink discharging amount change region) upon binarization in FIG. 14B.

In step S1507, clear ink plane information (clear ink data) after γ correction processing in step S1503 is loaded from the first print data. Based on the clear ink discharging amount change region information obtained from the second print data, the clear ink discharging amount in the region to undergo decoration printing in the first print data is changed to a discharging amount set in the clear ink discharging amount change region. More specifically, the pixel value of the clear ink plane after γ correction processing that corresponds to a pixel in the region assigned with "0" upon binarization is changed to a discharging amount designated in advance (is decreased). No clear ink discharging amount is changed for a region assigned with "1" upon binarization or a region having no clear ink discharging amount change region. In step S1508, halftone processing is performed to transmit the first print data to the inkjet printing apparatus. In step S1509, print processing is executed, completing the decoration print processing.

To achieve the decoration effect while maintaining the glossiness when performing decoration printing, the clear ink is printed by overcoat printing. This is because overcoat printing hardly degrades the image clarity, as described above. Simultaneous printing of the clear and color inks further roughens the surface, and the surface diffusely reflects light and seems hazy. To prevent this, the embodiment prints the clear ink by overcoat printing capable of greatly changing only the glossiness in accordance with the amounts of color and clear inks without degrading the image clarity.

Figure 13A:
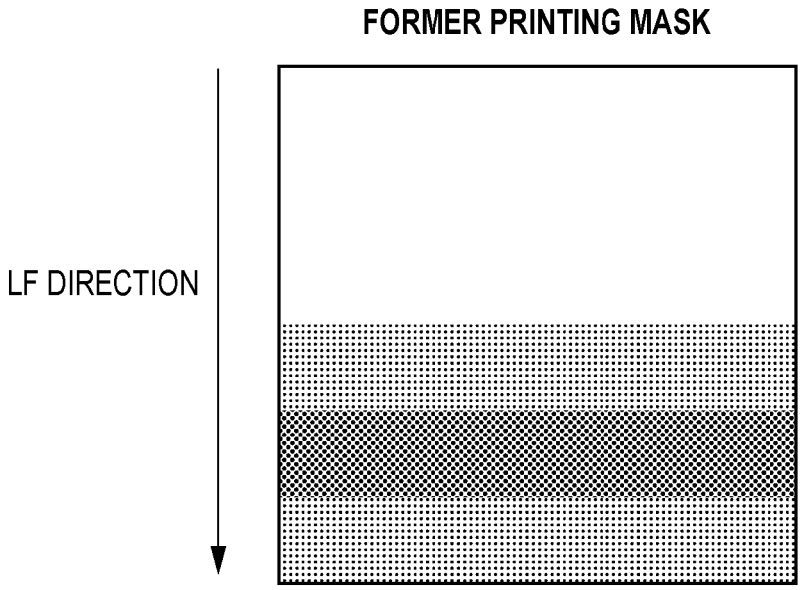
FIGS. 13A and 13B are views exemplifying masks which complete printing by six passes.
Figure 13B:
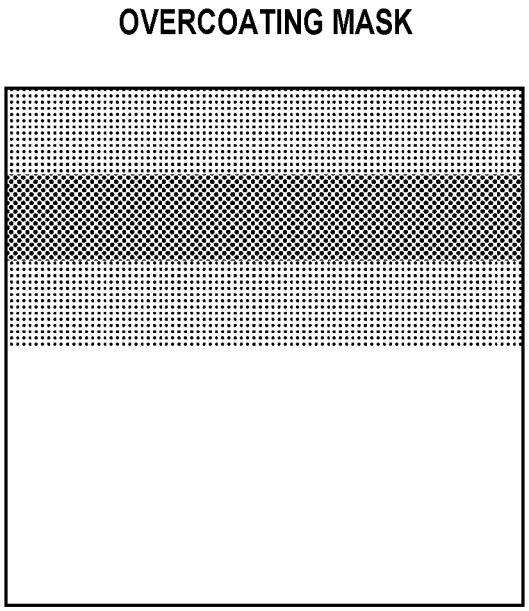

To implement overcoat printing of the clear ink, for example, the embodiment adopts masks which complete printing substantially by six passes as shown in FIGS. 13A and 13B. Inks are divided into an ink group of color inks and an ink group including the clear ink. A mask in FIG. 13A or 13B is selected for each ink group. FIG. 13A shows a mask which is used for the ink group of color inks and completes printing by three passes of the first half out of the six passes. A blank part of the second half is not printed because of the absence of a mask (printing-permitted pixels). FIG. 13B shows a mask which is used for the ink group including the clear ink and to perform overcoat printing. In contrast to the mask in FIG. 13A, the mask in FIG. 13B completes printing by three passes of the second half out of the six passes. A blank part of the first half is not printed because of the absence of a mask (printing-permitted pixels). As shown in FIGS. 13A and 13B, a print scan of the clear ink is executed after that of the color ink. Overcoat printing of the clear ink can therefore be done as shown in FIG. 10C. In the embodiment, the clear ink is printed upon completion of printing the color ink. However, both the color and clear inks may be printed in some passes. Although the 6-pass masks have been exemplified, the number of passes for the color and clear inks is arbitrary.

The embodiment can change the glossiness differently and give the decoration effect by changing the clear ink discharging amount in accordance with a portion to be decorated in an image. Overcoat printing of the clear ink can suppress roughening of the surface of a printed material and prevent diffuse reflection on the surface of the printed material. Accordingly, the embodiment can suppress degradation of the image clarity and implement both the decoration effect and glossy photograph.

[Second Embodiment]

Figure 14C:
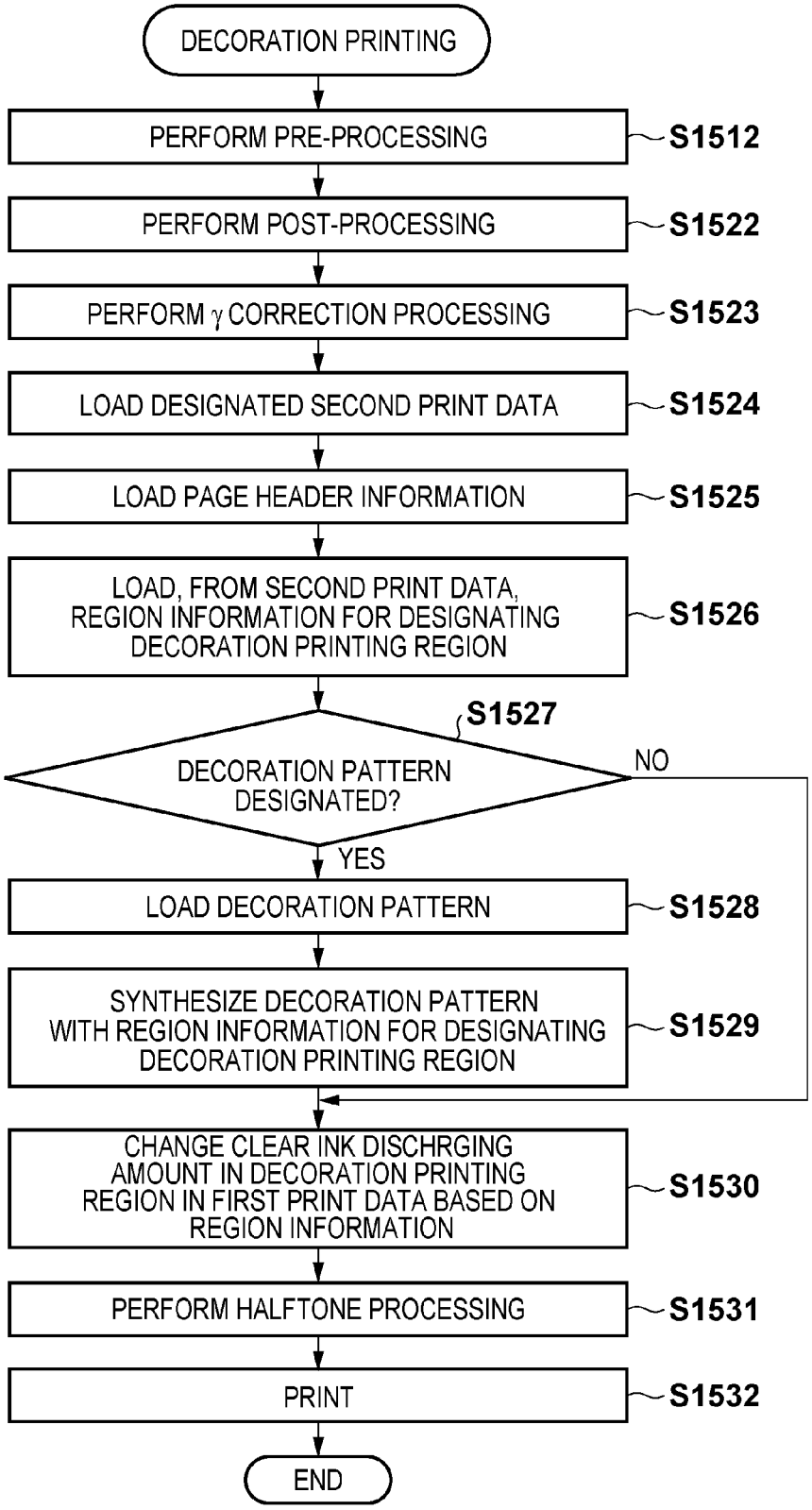

FIG. 14C is a flowchart showing the sequence of decoration print processing in the second embodiment. When performing decoration printing for expressing decoration, the user selects decoration print processing on a UI screen displayed on the monitor of a host apparatus J0012 shown in FIG. 1, selects the second print data created in advance, and starts decoration print processing for the first print data of an original image.

In steps S1521 to S1523, pre-processing J0002, post-processing J0003, and γ correction processing J0004 are performed. These processes are the same as those described with reference to FIG. 1. The first print data is converted into 8-bit multi-valued data in step S1523. At this time, the clear ink CL has a predetermined value in the entire printing range.

The second print data saved in advance is loaded in step S1524, and a page header written in the second print data is referred to in step S1525. In step S1526, region information is loaded from the page header into a RAM 105 to designate a region to undergo decoration printing.

In step S1527, it is determined from print setting information of the page header whether a decoration pattern has been designated. The decoration pattern is an image representing a pattern which is repetitively discharged to the clear ink discharging amount change region. The decoration pattern is formed from binary values "0" and "1", similar to the clear ink discharging amount change region. The decoration pattern is designated by the pattern type such as "no pattern", "circle", "square", or "rhombus", and the size such as "large", "middle", and "small". The printer driver has in advance a plurality of pattern images corresponding to respective combinations.

If it is determined in step S1527 that a decoration pattern has been designated, the process advances to step S1528 to load the decoration pattern image into the RAM 105. The process then advances to step S1529 to repetitively composite, in the clear ink discharging amount change region information, the decoration pattern image loaded in the RAM 105. This composition is done by repeating OR calculation for the clear ink discharging amount change region. As a result, the pattern image is superposed in a region where the binary value is "0" (a region where the clear ink discharging amount is changed).

FIG. 15 shows an example of the result of prompting the user to select one of a plurality of types of prepared decoration patterns (for example, no pattern, circle, square, and rhombus) for a specific portion to undergo decoration printing, and patterning a region where the clear ink discharging amount is changed. In FIG. 15, the region where the clear ink discharging amount is changed is a black portion at a portion to be decorated. In c) in FIG. 15, a checkered pattern is selected for a portion (heart-shaped portion) to be given the decoration effect. At the portion (heart-shaped portion) to be given the decoration effect, high-glossiness portions and low-glossiness portions are adjacent to each other, providing an effect of shining the heart-shaped image. Changing the decoration pattern size to "large", "middle", and "small" implements this effect at different glossinesses. For example, a size of 2 to 3 mm on a side of the decoration pattern can maximize the decoration effect based on the decoration pattern size.

Referring back to step S1527, if it is determined in step S1527 that no decoration pattern has been designated, the process advances to step S1530. In this case, the user has selected "no pattern", and the clear ink discharging amount at the portion (heart-shaped portion) to undergo decoration printing is changed uniformly, as shown in b) in FIG.15. In step S1530, a clear ink plane after y correction processing in step S1523 is loaded from the first print data. Based on the clear ink discharging amount change region information, the clear ink discharging amount in the region to undergo decoration printing in the first print data is uniformly changed to a discharging amount designated in advance. More specifically, processing of changing pixel values of the clear ink plane that correspond to pixels in a region where the binary value is "0" is performed. To the contrary, no value of the clear ink plane is changed for pixels in a region where the binary value is "1" or for a region having no clear ink discharging amount change region. In step S1531, halftone processing is performed to transmit the first print data to the inkjet printing apparatus. In step S1532, printing is executed, completing the decoration print processing.

In the embodiment, to achieve the decoration effect while maintaining the glossiness when performing decoration printing, the clear ink is printed by overcoat printing. This is because overcoat printing hardly degrades the image clarity, as described above. In contrast, simultaneous printing of the clear and color inks further roughens the surface, and the surface diffusely reflects light and seems hazy. To prevent this, the clear ink is printed by overcoat printing capable of greatly changing only the glossiness in accordance with the amounts of color and clear inks without degrading the image clarity.

To implement overcoat printing of the clear ink, for example, the embodiment adopts masks which complete printing substantially by six passes as shown in FIGS. 13A and 13B. Inks are divided into an ink group of color inks and an ink group including the clear ink. A mask shown in FIG. 13A or 13B is selected for each ink group. FIG. 13A shows a mask which is used for the ink group of color inks and completes printing by three passes of the first half out of the six passes. A blank part of the second half is not printed because of the absence of a mask. FIG. 13B shows a mask which is used for the ink group including the clear ink and to perform overcoat printing. In contrast to the mask in FIG. 13A, the mask in FIG. 13B completes printing by three passes of the second half out of the six passes. As shown in FIGS. 13A and 13B, a print scan of the clear ink is executed after that of the color ink. Hence, overcoat printing of the clear ink can be done as shown in FIG. 10C. Although the 6-pass masks have been exemplified, the number of passes for the color and clear inks is arbitrary.

[Third Embodiment]

In the first and second embodiments, the clear ink discharging amount in a region where decoration printing of the first print data is performed is changed to a discharging amount designated in advance. The changed clear ink discharging amount may be a "smaller value" than a clear ink discharging amount in the original first print data or may be 0. Changing the clear ink discharging amount to be smaller or 0 can increase the glossiness only at a portion to be decorated, as shown in FIG. 11B. As a result, the glossiness can be changed differently to implement the decoration effect, and the text and image seem popping up.

The user may determine the clear ink discharging amount. For example, a user interface screen is displayed to change the clear ink discharging amount in the clear ink plane of the first print data to any one of discharging amounts "50%, 30%, 10%, and 0%". The user interface screen prompts the user to select one discharging amount, thereby changing the glossiness. When the clear ink discharging amount in the clear ink plane of the original first print data is "100", the clear ink discharging amount in a region to be given the decoration effect is "50", "30", "10", or "0".

Further, the clear ink discharging amount may be increased from that in the clear ink plane of the original first print data. In this case, the glossiness decreases as shown in FIG. 11B. Since the clear ink has already been discharged, an excessively large clear ink discharging amount may cause beading or bleeding. Thus, the discharging amount needs to be set carefully.

[Fourth Embodiment]

Figure 12A:
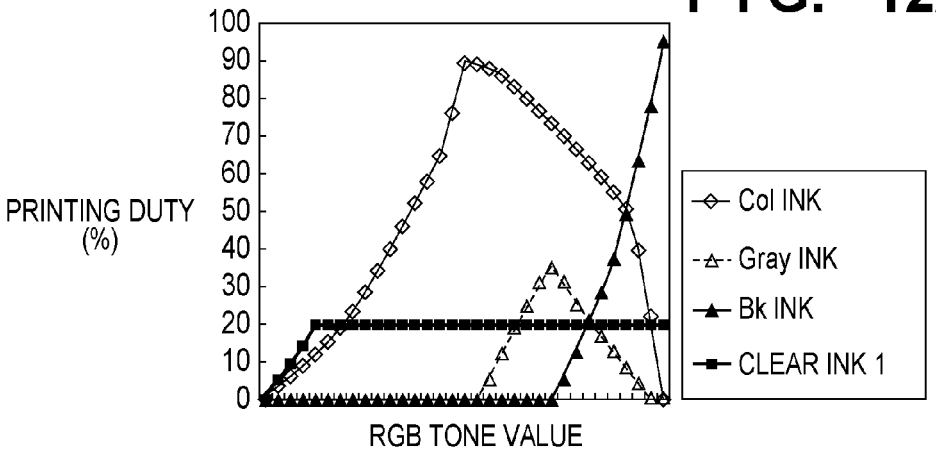
FIGS. 12A to 12C are tables each schematically showing a lookup table (LUT)
Figure 12B:
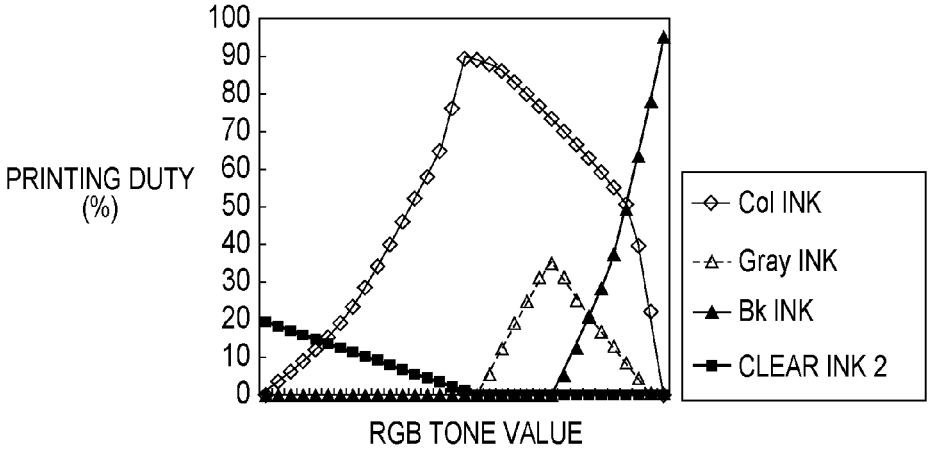
Figure 12C:
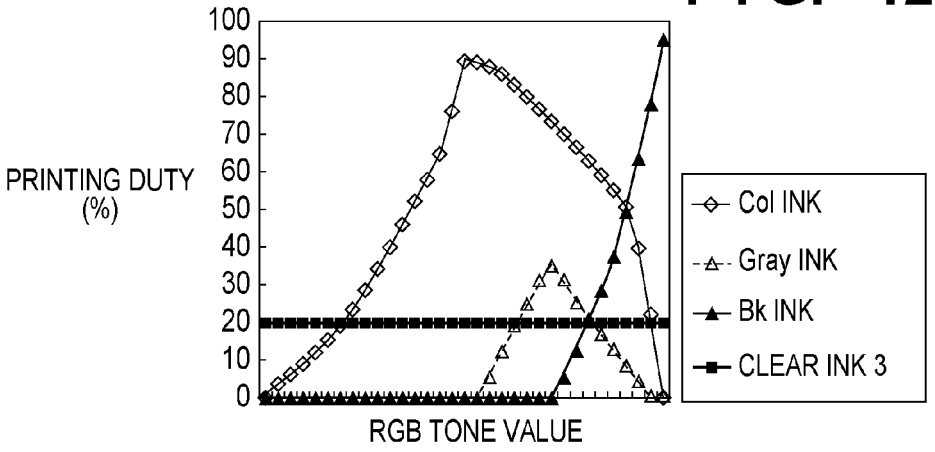

FIGS. 12A to 12C are tables each schematically showing a lookup table (LUT) used in color conversion processing in the embodiment shown in FIG. 1. The use of the clear ink in a table for a White-Col-Bk line (Col is any hue among C, M, Y, and R) in a given hue will be explained as an example of the LUT. The abscissa indicates the RGB tone value of image data. The leftmost value indicates a white point (255, 255, 255), and the rightmost value indicates a black point (0, 0, 0). The ordinate indicates the ink discharging amount (printing duty) with respect to each signal value. In practice, Col inks of a plurality of colors are adopted for each RGB value of image data, and the use of color is more complicated. For descriptive convenience, a Col ink of only one color will be exemplified in the embodiment, but the use of ink is not limited to this. Generally on a White-Col line, the Col ink discharging amount (printing duty) is increased up to the maximum saturation. In the embodiment, a printing duty obtained when eight ink droplets of about 3.5 pl are printed in a pixel of 600 dpi×600 dpi is defined as 100%. Lightness needs to be decreased to connect Col and Bk, and black carbon ink-containing inks (for example, gray and Bk) are mainly used in general. In the embodiment, the gray ink is used first in consideration of graininess at the start of using black, and then Bk is used to decrease lightness.

The clear ink discharging amount changes depending on the purpose of a printed material, as shown in FIGS. 12A to 12C. For example, as shown in FIG. 12A, the clear ink is discharged not at a white point (255, 255, 255) but by a large amount at a portion printed in color. FIG. 12A shows a case in which the difference in glossiness from a low-glossiness white point is canceled by decreasing the glossiness at a color ink-printed portion. In contrast to FIG. 12A, as shown in FIG. 12B, the clear ink is discharged by a large amount at a white point (255, 255, 255) and by a small amount at a portion where almost all the white background of a printing medium is covered with the color ink. FIG. 12B shows a case in which the difference in glossiness from a color ink-printed portion is canceled by increasing the glossiness on the white background of a printing medium. Alternatively, the clear ink is discharged uniformly regardless of the input RGB value, as shown in FIG. 12C. FIG. 12C shows a case in which the difference in glossiness is canceled by suppressing an excessively high glossiness at a color ink-printed portion while increasing even the glossiness on the white background of a printing medium.

In normal printing, the clear ink is used as shown in FIG. 12A or 12B in order to uniform the gloss. The clear ink may be used as shown in FIG. 12C, as a matter of course. However, the clear ink discharging amount is preferably optimized in normal printing in consideration of the clear ink consumption amount, so the clear ink is often used as shown in FIG. 12A or 12B. In this case, however, the effect of decoration printing as described in the embodiment cannot be obtained at a portion using no clear ink. To solve this, only the clear ink may be discharged by double feeding (double printing). If the pigment ink is fixed before the second printing, the clear ink to be printed by the second printing is hardly absorbed in a printing medium, and an image error such as beading or bleeding may occur. Further, double feeding doubles the printing time. It is therefore preferable in the decoration printing mode to discharge the clear ink at a white point (255, 255, 255) as shown in FIG. 12C and also in an image-free printable region in order to obtain the decoration effect by the clear ink at all portions on the printing medium. This can obviate the need for double feeding, preventing the above-mentioned problem that the clear ink is hardly absorbed in a printing medium. For this reason, in the use of the decoration printing mode according to the embodiment, the clear ink is discharged to the entire printable region of a printing medium. The decoration effect can be added to a portion having an image of any input value, such as the white background of a printing medium.

<Other Embodiments>

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (for example, computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-195064, filed Aug. 31, 2010, which is hereby incorporated by reference herein in its entirety.

What is claimed is:

1. An image processing apparatus for printing an image on a print medium using a printhead for discharging at least one type of color ink containing a color material and a clear ink for adjusting glossiness of the image during a scanning which is performed relatively between the printhead and the print medium such that the color ink is overcoated by the clear ink, the apparatus comprising:

a determining unit configured to determine discharging amounts of the color ink and the clear ink on the print medium based on data of the image;

an obtaining unit configured to obtain information representing a patterned decoration region for expressing patterned decoration on the image printed on the print medium;

a changing unit configured to change the discharging amount of the clear ink in the patterned decoration region represented by the information obtained by the obtaining unit without changing the discharging amount of the clear ink in a remaining region other than the patterned decoration region; and a generation unit configured to generate print data for the printing by the printhead based on the discharging amount of the color ink determined by the determining unit, the discharging amount of the clear ink for the patterned decoration region changed by the changing unit, and the discharging amount of the clear ink for the remaining region which is not changed by the changing unit.

2. An image processing method of printing an image on a print medium using a printhead for discharging at least one type of color ink containing a color material and a clear ink for adjusting glossiness of the image during a scanning which is performed relatively between the printhead and the print medium such that the color ink is overcoated by the clear ink, the method comprising:

determining discharging amounts of the color ink and the clear ink on the print medium based on data of the image;

obtaining information representing a patterned decoration region for expressing patterned decoration on the image printed on the print medium;

changing the discharging amount of the clear ink in the patterned decoration region represented by the obtained information without changing the discharging amount of the clear ink in a remaining region other than the patterned decoration region; and generating print data for the printing by the printhead based on the discharging amount of the color ink determined in the determining, the discharging amount of the clear ink for the patterned decoration region changed in the changing, and the discharging amount of the clear ink for the remaining region which is not changed in the changing.

3. The method according to claim 2, further comprising:

selecting at least one decoration pattern from a plurality of pre-determined decoration patterns for determining the patterned decoration region, wherein the information is obtained in the obtaining based on the selected pattern.

4. The method according to claim 2, wherein in the changing, the discharging amount of the clear ink in the patterned decoration region is changed to zero.

5. The method according to claim 2, wherein in the changing, the discharging amount of the clear ink in the patterned decoration region is changed to be smaller than the discharging amount of the clear ink determined in the determining.

6. The method according to claim 2, wherein in the changing, the discharging amount of the clear ink in the patterned decoration region is changed to an amount of the clear ink based on input by a user.

7. The method according to claim 5, wherein the patterned decoration region is a region to be printed with glossiness different from glossiness of the remaining region.

8. The method according to claim 2, wherein, in the determining, the discharging amount of the clear ink is determined such that the clear ink is discharged on an entire printing region of the print medium.

9. The method according to claim 2, wherein the color ink and the clear ink are discharged in a predetermined area while performing the scanning a plurality of times, and wherein the clear ink is discharged in a scanning which is later than a scanning in which the color ink is discharged.

10. The apparatus according to claim 1, further comprising:

a selection unit for selecting at least one decoration pattern from a plurality of pre-determined decoration patterns for determining the patterned decoration region, wherein the information is obtained by the obtaining unit based on the selected decoration pattern.

11. The apparatus according to claim 1, wherein the changing unit changes the discharging amount of the clear ink in the patterned decoration region to zero.

12. The apparatus according to claim 1, wherein the changing unit changes the discharging amount of the clear ink in the patterned decoration region to be smaller than the discharging amount of the clear ink determined by the determining unit.

13. The apparatus according to claim 1, wherein the discharging amount of the clear ink in the patterned decoration region is changed to an amount of the clear ink based on input by a user.

14. The apparatus according to claim 12, wherein the patterned decoration region is a region to be printed with glossiness different from glossiness of the remaining region.

15. The apparatus according to claim 1, wherein the discharging amount of the clear ink is determined such that the clear ink is discharged on an entire printing region of the print medium.

16. The apparatus according to claim 1, wherein the color ink and the clear ink are discharged in a predetermined area while performing the scanning a plurality of times, and wherein the clear ink is discharged in a scanning which is later than a scanning in which the color ink is discharged.

17. A non-transitory computer readable medium containing program instructions for causing a computer to perform the method of printing an image on a print medium using a printhead for discharging at least one type of color ink containing a color material and a clear ink for adjusting glossiness of the image during a scanning which is performed relatively between the printhead and the print medium such that the color ink is overcoated by the clear ink, the method comprising:

determining discharging amounts of the color ink and the clear ink on the print medium based on data of the image;

obtaining information representing a patterned decoration region for expressing patterned decoration on the image printed on the print medium;

changing the discharging amount of the clear ink in the patterned decoration region represented by the obtained information without changing the discharging amount of the clear ink in a remaining region other than the patterned decoration region; and generating print data for the printing by the printhead based on the discharging amount of the color ink determined in the determining, the discharging amount of the clear ink for the patterned decoration region changed in the changing, and the discharging amount of the clear ink for the remaining region which is not changed in the changing.

18. The non-transitory computer readable medium according to claim 17, wherein the method further comprises selecting at least one decoration pattern from a plurality of pre-determined decoration patterns for determining the patterned decoration region, and wherein the information is obtained in the obtaining based on the selected pattern.

19. The non-transitory computer readable medium according to claim 17, wherein in the changing, the discharging amount of the clear ink in the patterned decoration region is changed to zero.

20. The non-transitory computer readable medium according to claim 17, wherein in the changing, the discharging amount of the clear ink in the patterned decoration region is changed to be smaller than the discharging amount of the clear ink determined in the determining.

21. The non-transitory computer readable medium according to claim 17, wherein in the changing, the discharging amount of the clear ink in the patterned decoration region is changed to an amount of the clear ink based on input by a user.

22. The non-transitory computer readable medium according to claim 20, wherein the patterned decoration region is a region to be printed with glossiness different from glossiness of the remaining region.

23. The non-transitory computer readable medium according to claim 17, wherein, in the determining, the discharging amount of the clear ink is determined such that the clear ink is discharged on an entire printing region of the print medium.

24. The non-transitory computer readable medium according to claim 17, wherein the color ink and the clear ink are discharged in a predetermined area while performing the scanning a plurality of times, and wherein the clear ink is discharged in a scanning which is later than a scanning in which the color ink is discharged.

* * * * *